US011320209B2

(12) United States Patent
Tseng et al.

(10) Patent No.: US 11,320,209 B2
(45) Date of Patent: May 3, 2022

(54) PULSATING HEAT PIPE

(71) Applicant: INDUSTRIAL TECHNOLOGY RESEARCH INSTITUTE, Hsinchu (TW)

(72) Inventors: Chih-Yung Tseng, Yunlin County (TW); Shih-Kuo Wu, Hsinchu (TW); Wen-Hua Zhang, Zhubei (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 239 days.

(21) Appl. No.: 16/743,951

(22) Filed: Jan. 15, 2020

(65) Prior Publication Data

US 2021/0131741 A1 May 6, 2021

(30) Foreign Application Priority Data

Nov. 4, 2019 (TW) ..... 108139982

(51) Int. Cl.
*F28D 15/02* (2006.01)
*F28D 15/04* (2006.01)
(Continued)

(52) U.S. Cl.
CPC ..... *F28D 15/025* (2013.01); *F28D 15/0266* (2013.01); *F28F 13/10* (2013.01)

(58) Field of Classification Search
CPC ..... F28F 13/10; F28D 15/0233; F28D 15/04; F28D 15/043; F28D 2015/0216; F28D 2015/0225
See application file for complete search history.

(56) References Cited

U.S. PATENT DOCUMENTS 4,921,041 A * 5/1990 Akachi ..... F28D 15/00 165/104.14
5,642,775 A * 7/1997 Akachi ..... F28D 15/0233 165/104.14
(Continued)

FOREIGN PATENT DOCUMENTS

CN 101131306 A 2/2008
CN 102062552 A 5/2011
(Continued)

OTHER PUBLICATIONS

Chien, K.H. et al., "A novel design of pulsating heat pipe with fewer turns applicable to all orientations," International Journal of Heat and Mass Transfer, vol. 55, Issues 21-22, pp. 5722-5728 (Oct. 2012).
(Continued)

*Primary Examiner* — Frantz F Jules
*Assistant Examiner* — Jason N Thompson
(74) *Attorney, Agent, or Firm* — Maschoff Brennan

(57) ABSTRACT

The disclosure relates to a pulsating heat pipe including channel plate. The channel plate includes first surface, second surface, first channels, second channels, first passages, second passages, at least one chamber, and at least one third passage. The first channels and the chamber are formed on the first surface, the channels are formed on the second surface, and the first passages, the second passages, and the third passage penetrate through the first and second surfaces. The chamber has a closed end located opposite to the third passage and connected to at least one of the second channels via the third passage. The first and second channels are connected via the first and second passages. The chamber has a hydraulic diameter of $D_h$ which satisfies the following condition:
(Continued)

$$D_h > 2\sqrt{\frac{\sigma}{\Delta\rho g}},$$

wherein σ is surface tension, Δρ is difference in density between liquid and vapor, and g is gravitational acceleration.

17 Claims, 9 Drawing Sheets

(51) Int. Cl.

| | |
|---|---|
| ***F28F 3/12*** | (2006.01) |
| ***F28F 13/08*** | (2006.01) |
| ***F28F 13/10*** | (2006.01) |

(56) References Cited

U.S. PATENT DOCUMENTS

| | | | | |
|---|---|---|---|---|
| 5,697,428 | A * | 12/1997 | Akachi | F28D 15/0233 165/104.14 |
| 6,672,373 | B2 | 1/2004 | Smyrnov | |
| 8,256,501 | B2 * | 9/2012 | Nagai | F28D 15/0233 165/80.4 |
| 8,919,426 | B2 | 12/2014 | Hardesty | |
| 9,184,363 | B2 | 11/2015 | Lee | |
| 10,258,310 | B2 | 4/2019 | Kim et al. | |
| 10,264,707 | B2 | 4/2019 | Kim et al. | |
| 2003/0037910 | A1 * | 2/2003 | Smyrnov | F28D 15/06 165/104.26 |
| 2003/0192674 | A1 | 10/2003 | Ippoushi et al. | |
| 2004/0035555 | A1 * | 2/2004 | Nara | H05K 7/20272 165/84 |
| 2005/0081552 | A1 * | 4/2005 | Nilson | F28D 15/043 62/311 |
| 2005/0262720 | A1 | 12/2005 | Rane et al. | |
| 2006/0144565 | A1 * | 7/2006 | Tsai | F28D 15/0233 165/104.26 |
| 2009/0323276 | A1 | 12/2009 | Mongia et al. | |
| 2013/0133871 | A1 * | 5/2013 | Ma | H01L 23/427 165/185 |
| 2015/0060019 | A1 * | 3/2015 | Tseng | F28D 15/0266 165/104.25 |
| 2015/0323261 | A1 * | 11/2015 | Tseng | F28D 15/0233 165/104.22 |
| 2016/0037681 | A1 | 2/2016 | Lee et al. | |
| 2016/0054074 | A1 * | 2/2016 | Agostini | F28F 1/022 165/104.26 |
| 2016/0242320 | A1 | 8/2016 | Agostini et al. | |
| 2017/0245393 | A1 * | 8/2017 | Kim | F28F 13/10 |
| 2018/0180360 | A1 * | 6/2018 | Katoh | F28D 15/0283 |
| 2018/0283798 | A1 | 10/2018 | Kim et al. | |
| 2019/0113288 | A1 * | 4/2019 | Cheng | F28D 15/025 |
| 2019/0195567 | A1 * | 6/2019 | Wang | F28D 15/0266 |
| 2020/0088479 | A1 | 3/2020 | Tseng et al. | |

FOREIGN PATENT DOCUMENTS

| | | | |
|---|---|---|---|
| CN | 101789459 | B | 3/2012 |
| CN | 103380297 | A | 10/2013 |
| CN | 104470323 | A | 3/2015 |
| CN | 104422319 | B | 8/2016 |
| CN | 105091643 | B | 5/2017 |
| CN | 107466195 | A | 12/2017 |
| CN | 109668459 | A | 4/2019 |
| CN | 110906767 | A | 3/2020 |
| EP | 3 336 471 | A1 | 6/2018 |
| TW | I387718 | B | 3/2013 |
| TW | I580921 | B | 5/2017 |
| TW | M542759 | U | 6/2017 |
| TW | 201915424 | A | 4/2019 |
| TW | 202010993 | A | 3/2020 |
| WO | 2011/035943 | A2 | 3/2011 |

OTHER PUBLICATIONS

Hathaway, A. A. et al., "Experimental Investigation of Uneven-Turn Water and Acetone Oscillating Heat Pipes," Journal of Thermophysics and Heat Transfer, vol. 26, No. 1, pp. 115-122 (Jan.-Mar. 2012).

Mohammadi, M. et al., "Ferrofluidic Open Loop Pulsating Heat Pipes: Efficient Candidates for Thermal Management Of Electronics," Experimental Heat Transfer, vol. 27, No. 3, pp. 296-312 (2014).

Hu, Y. et al., "Heat transfer enhancement of micro oscillating heat pipes with self-rewetting fluid," International Journal of Heat and Mass Transfer, vol. 70, pp. 496-503 (2014).

Tseng, C. Y. et al., "Investigation of the performance of pulsating heat pipe subject, to uniform/alternating tube Diameters," Experimental Thermal and Fluid Science, vol. 54, pp. 85-92 (2014).

Ma, H., "Oscillating Heat Pipes" Springer, pp. 146 (2015).

TW Notice of Allowance dated Jul. 14, 2020 as received in Application No. 108139982.

* cited by examiner

PULSATING HEAT PIPE

CROSS-REFERENCE TO RELATED APPLICATIONS

This non-provisional application claims priority under 35 U.S.C. § 119(a) on Patent Application No(s). 108139982 filed in R.O.C. Taiwan on Nov. 4, 2019, the entire contents of which are hereby incorporated by reference.

TECHNICAL FIELD

The disclosure relates to a pulsating heat pipe, more particularly to a pulsating heat pipe having a chamber.

BACKGROUND

Heat pipes are one of the most efficient ways to move thermal energy from one point to another, thus heat pipes are widely used for the heat removal of electronics. To remove heat generated by a flat heat source, it usually requires multiple heat pipes at the same time. However, the use of multiple heat pipes makes the design, installation, and manufacturing process more difficult to implement. Therefore, flat heat pipes were developed and used to spread heat of flat heat source. The flat heat pipes are more suitable for uniform heat dissipation of a large surface area compared with the conventional heat pipe.

A typical flat heat pipe uses a sintered wick structure exerting a capillary force on the liquid phase of a working fluid to transport the condensed liquid at the condensation section to the evaporation section. However, the ability of the wick structure to provide the circulation for a given working fluid from the condensation section to the evaporation section is very limited and the amount of heat transferring is inversely proportional to the travel distance that the wick structure can transport the working fluid. Therefore, the size of the sintered wick heat pipe is not too large, such that the sintered wick heat pipe only can offer a small coverage area with a low heat transfer rate. Also, the sintered wick heat pipe is unable to effectively operate in an application that needs to anti-gravity. As such, the sintered wick heat pipe is not suitable for the application of large area and high power heat transfer. In addition, the manufacturing process of the sintered wick structure results in difficulties for the conventional flat heat pipes, the main reasons are as follow: 1. The larger the flat heat pipe, the more difficult it is to control the uniformity of the wick structure, which easily leads to unstable performance; 2. The larger the flat heat pipe, the larger the sintering furnace for sintering the wick structure, which increases the manufacturing cost and reduces the production speed; 3, after annealing, the wall strength of the flat heat pipe is greatly reduced to a level not sufficient to withstand the variation of the internal and external pressures.

Therefore, the concept of pulsating heat pipes (PHP), also referred to as oscillating heat pipes (OHP), was presented in the market. The pulsating heat pipe is made of a pipe having several turns and straight sections connected in series, where the inner diameter of the channel of the pipe is small enough to ensure that the surface tension of the working fluid is large enough to form randomly distributed vapor and liquid plugs. The liquid plugs are interspersed with the vapor bubbles, as heat is applied to the evaporation section, the working fluid begins to evaporate and which results in an increase of vapor pressure inside the pipe to cause the bubbles to push the liquid. At the condenser section, the vapor pressure reduces and condensation of bubbles occurs. This process between the evaporation and condensation sections is continuous and results in an oscillating motion within the pipe. It can be seen that the pulsating heat pipe is simple in configuration and does not require a wick structure to transport liquid, so the pulsating heat pipe gradually replaces the conventional sintered wick heat pipe.

However, the conventional pulsating heat pipes provide a very limited capillary force so that the conventional pulsating heat pipes rely on gravity for its working and can only be operated in an upright position (bottom-heated application). When the conventional pulsating heat pipe is placed horizontally or applied to a top-heated application, the liquid lacks the assist of gravity and has to move against gravity, such that the pulsating motion is gradually weakened and which even leads the working liquid to a stationary status. To prevent this problem, some try to add one or more non-return valves to restrict the working fluid to flow in a specific direction. But the non-return valve increases the manufacturing costs and design complexity. Some try to increase the number of turns to make the pressure of the working fluid at the evaporation and condensation sections more difficult to reach a balance, but increasing the number of turns makes the overall volume too large. Moreover, while forming the turns of small radius, the pipe is easily unwantedly deformed or broken and which often results in invalid areas in the loop and thus reducing the channel utilization. Accordingly, the conventional pulsating heat pipes require improvements to overcome the above issues.

SUMMARY

One embodiment of the disclosure provides a pulsating heat pipe including channel plate. The channel plate includes first surface, second surface, first channels, second channels, first passages, second passages, at least one chamber, and at least one third passage. The first channels and the chamber are formed on the first surface, the channels are formed on the second surface, and the first passages, the second passages, and the third passage penetrate through the first and second surfaces. The chamber has a closed end located opposite to the third passage and connected to at least one of the second channels via the third passage. The first and second channels are connected via the first and second passages. The chamber has a hydraulic diameter of $D_h$ which satisfies the following condition:

$$D_h > 2\sqrt{\frac{\sigma}{\Delta\rho g}},$$

wherein σ is surface tension, Δρ is difference in density between liquid and vapor, and g is gravitational acceleration.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Figure 1:
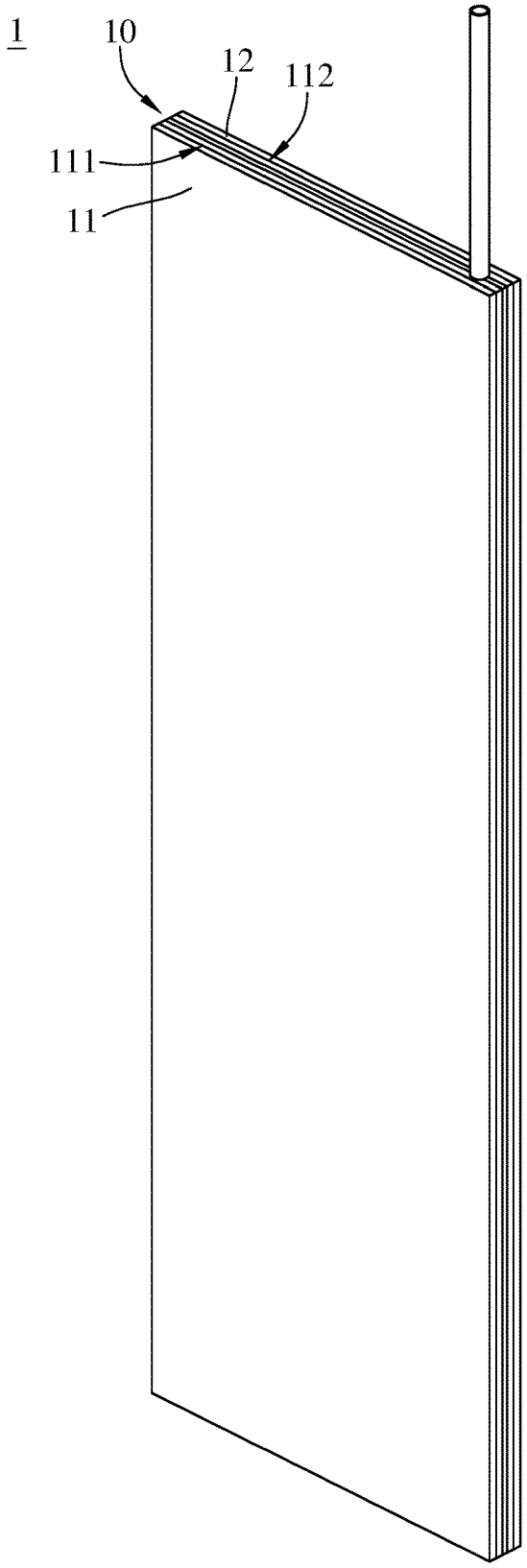
FIG. 1 is a perspective view of a pulsating heat pipe according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details.

In addition, for the purpose of simple illustration, well-known features may be drawn schematically, and some unnecessary details may be omitted from the drawings. And the size or ratio of the features in the drawings of the present disclosure may be exaggerated for illustrative purposes, but the present disclosure is not limited thereto. Note that the actual size and designs of the product manufactured based on the teaching of the present disclosure may also be properly modified according to any actual requirement.

Further, as used herein, the terms "end", "part", "portion" or "area" may be used to describe a technical feature on or between component(s), but the technical feature is not limited by these terms. In the followings, the term "and/or" may be used to indicate that one or more of the cases it connects may occur. Also, in the followings, it may use terms, such as "substantially", "approximately" or "about"; when these terms are used in combination with size, concentration, temperature or other physical or chemical properties or characteristics, they are used to express that, the deviation existing in the upper and/or lower limits of the range of these properties or characteristics or the acceptable tolerances caused by the manufacturing tolerances or analysis process, would still able to achieve the desired effect.

Furthermore, unless otherwise defined, all the terms used in the disclosure, including technical and scientific terms, have their ordinary meanings that can be understood by those skilled in the art. Moreover, the definitions of the above terms are to be interpreted as being consistent with the technical fields related to the disclosure. Unless specifically defined, these terms are not to be construed as too idealistic or formal meanings.

Figure 2A:
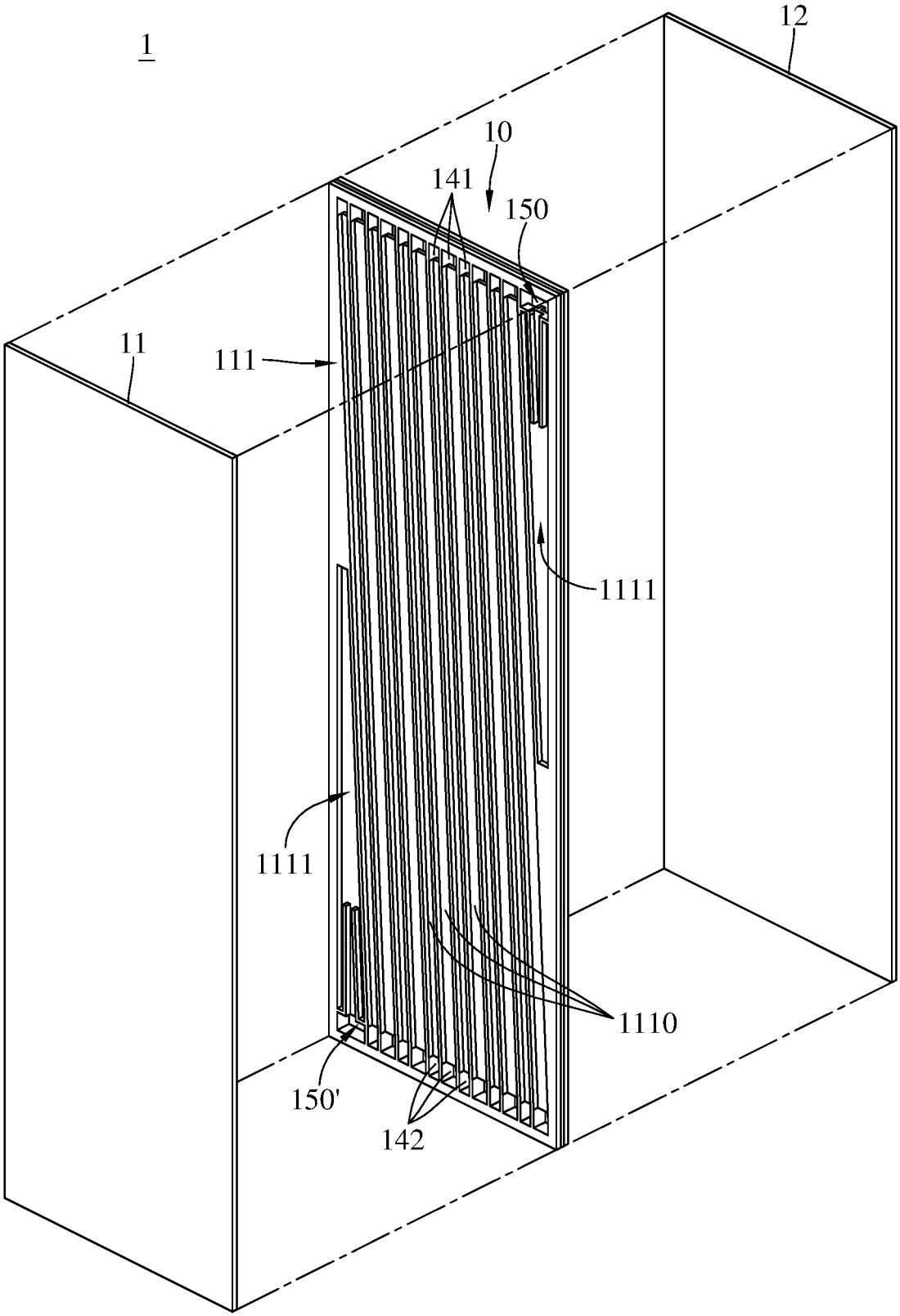
FIGS. 2A-2B are exploded perspective views of the pulsating heat pipe in FIG. 1, taken from different viewpoints.
Figure 2B:
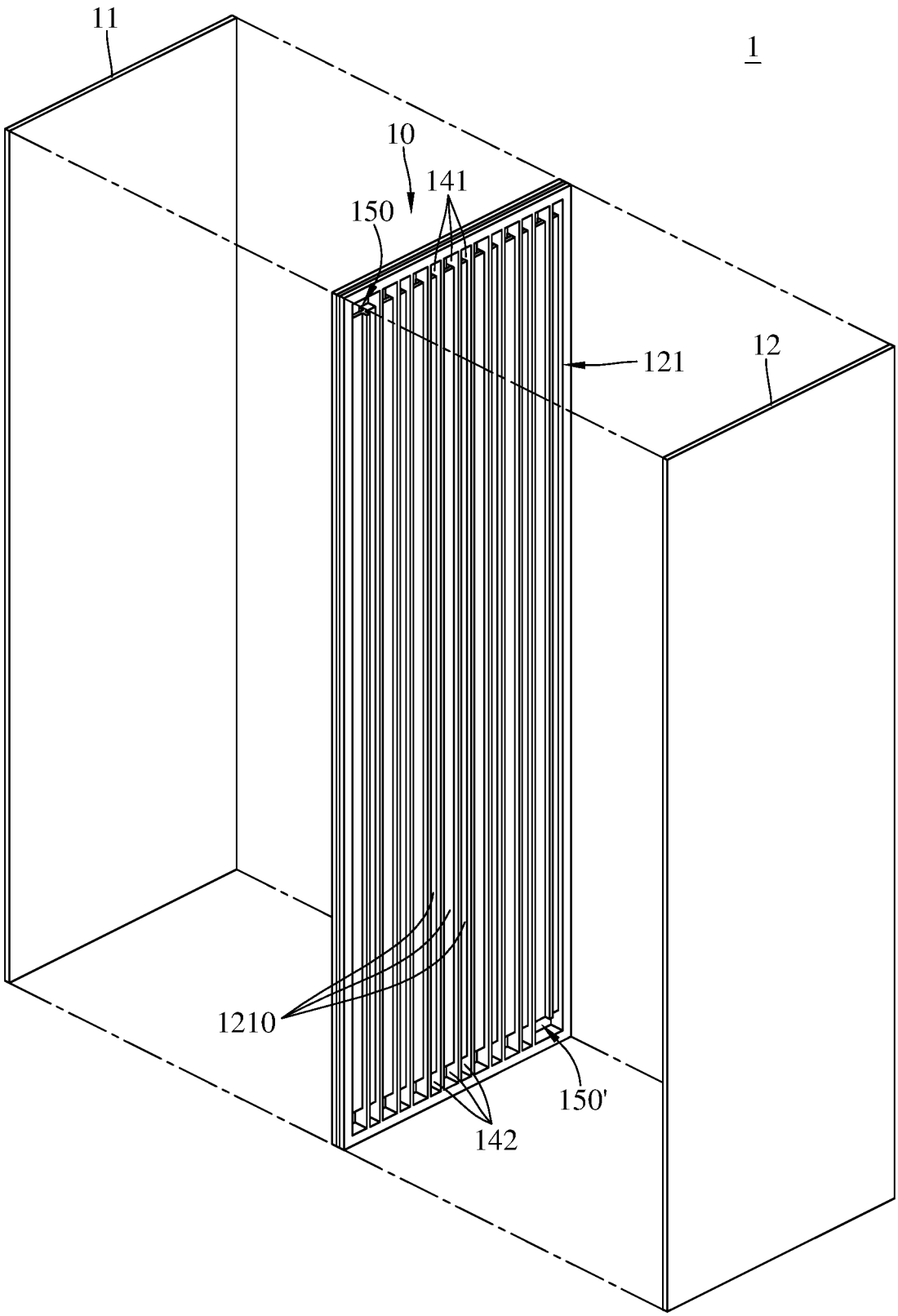

Firstly, referring to FIGS. 1-2B, one embodiment of the disclosure provides a pulsating heat pipe 1, wherein FIG. 1 is a perspective view of the pulsating heat pipe 1, and FIGS. 2A-2B are exploded perspective views of the pulsating heat pipe 1 taken from different viewpoints.

In this embodiment, the pulsating heat pipe 1 at least includes a channel plate 10, a first cover plate 11, and a second cover plate 12. As shown, the channel plate 10 has a first surface 111 and a second surface 121 opposite to each other. The first cover plate 11 and the second cover plate 12 are respectively disposed on the first surface 111 and the second surface 121 of the channel plate 10. In other words, the channel plate 10 is located between and clamped by the first cover plate 11 and the second cover plate 12. The first cover plate 11 and the second cover plate 12 are respectively fixed to the first surface 111 and the second surface 121 of the channel plate 10 by, for example, welding, adhering, or any other suitable manner, but the disclosure is not limited thereto.

In more detail, the channel plate 10 includes a plurality of first channels 1110, a plurality of second channels 1210, a plurality of first passages 141, a plurality of second passages 142, at least one chamber 1111, and at least one third passage 150 and 150'. The first channels 1110 are formed on the first surface 111 and arranged substantially parallel to one another. The second channels 1210 are formed on the second surface 121 and arranged substantially parallel to one another. In other words, the first channels 1110 and the second channels 1210 are respectively formed on two opposite surfaces of the channel plate 10. In addition, in this or some other embodiments, the first channels 1110 and the second channels 1210 are the straight channels on the channel plate 10.

The first passages 141 and the second passages 142 are respectively arranged along two opposite sides of the channel plate 10, and the first passages 141 and the second passages 142 all penetrate through the first surface 111 and the second surface 121. The channel plate 10 has, for example, two chambers 1111, wherein the chambers 1111 are both formed on the first surface 111 and are respectively arranged at two opposite sides of the channel plate 10. Specifically, these two chambers 1111 do not penetrate through the second surface 121. The third passages 150 and 150' are respectively arranged at two diagonal corners of the channel plate 10 and respectively connected to the chambers 1111, wherein the third passages 150 and 150' both penetrate through the first surface 111 and the second surface 121.

In this embodiment, the first channels 1110 and the second channels 1210 that are respectively located on the first surface 111 and the second surface 121 and the chambers 1111 located on the first surface 111 can be connected via the first passages 141, second passages 142, and third passages 150 and 150' so as to form a closed loop. On the first surface 111, the first channels 1110 are not directly connected to one another; in addition, on the second surface 121, some of the second channels 1210 are connected via the third passages 150 and 150', but the rest second channels 1210 are not directly connected to one another; further, on the first surface 111, the chambers 1111 are not directly connected to each other and are not directly connected to the first channels 1110. The term "directly connected" or "directly connect" used herein is to mean that the structures, features, or areas are directly fluidly connected so to allow working fluid to directly flow therethrough; on the other hand, the term "indirectly connected" used is herein to mean that structures, features, or areas are indirectly fluidly connected so that the structures, features, or areas require other structures, features, or areas to achieve their fluid connection.

The first channels 1110, the second channels 1210, the first passages 141, the second passages 142, and the third passages 150 and 150' are in a size that is small enough to ensure that the surface tension of the working fluid is large enough to form randomly distributed liquid plugs and vapor bubbles in the loop. The heat at the evaporator section vaporizes the liquid plugs into vapors and increases the pressure of the vapor plugs at the evaporator section. The pressure increase of the vapor plugs in the evaporator section will push the neighboring vapor and liquid plugs towards the condenser, which is at a lower pressure, and the vapors can be condensed there. The liquid is transported back to the evaporator section. As such, the heat is transferred mainly due to the latent heat absorption in the evaporator section and its release in the condenser section.

More specifically, regarding the above channels, passages, and holes on the channel plate 10, their hydraulic diameters ($D_h$) at least satisfies the following condition:

$$0.7\sqrt{\frac{\sigma}{\Delta\rho g}} \le D_h \le 1.8\sqrt{\frac{\sigma}{\Delta\rho g}},$$

wherein $D_h$=4A/P; A is the cross-sectional area of pipe ($m^2$); P is the perimeter of pipe (m); σ is the surface tension (N/m); Δρ is the difference in density between liquid and vapor ($kg/m^3$); g is gravitational acceleration ($m/s^2$).

In such a range, the hydraulic diameter $D_h$ falls within a theoretical range corresponding to approximately 0.49 to 3.24 times the bond number (Bo), where $$Bo = \frac{\Delta\rho g D_h^2}{\sigma}$$

is used to characterize the comparative action of the capillary force and gravity. In the small Bo regime, gravity has less domination on the behavior so that the surface tension of the working fluid may be large enough to form capillary action, that is, the smaller the Bo value, the stronger the capillary force it is to dominate the behavior of the working fluid; on the other hand, in the large Bo regime, gravity dominates the behavior so that the surface tension of the working fluid may not be sufficient to form a capillary action, that is, the capillary force is unable to dominate the working fluid. Therefore, under the condition of $$0.7\sqrt{\frac{\sigma}{\Delta\rho g}} \le D_h \le 1.8\sqrt{\frac{\sigma}{\Delta\rho g}},$$

the corresponding Bo value approximately ranges between 0.49 and 3.24. In this range of the Bo value, the working fluid can form randomly distributed vapor and liquid plugs in these portions of the loop.

In some embodiments, the hydraulic diameter $D_h$ of the above sections (i.e., the first channels 1110, the second channels 1210, the first passages 141, the second passages 142, and the third passages 150 and 150') approximately ranges between, for example, 0.5 mm and 2.0 mm. Note that the actual size of these portions of the loop and the aforementioned condition are not particularly restricted and may be modified according to actual requirements. It should be understood that, if the inner diameter of the pipe is too large, wave flow will be formed to impede the working fluid to form the alternation of liquid and vapor plugs. Also, if the inner diameter of the pipe is too small, the flow resistance will increase to against the pulsating motion. Therefore, too large and too small inner diameter of the pipe will impede the generation of the oscillation of the working fluid and thus failing to achieve the desired thermal performance. Accordingly, as long as the above portions of the loop are in a proper size to allow the working fluid to form the alternation of vapor and liquid plugs, their sizes or hydraulic diameters may be modified according to actual requirements.

In addition, the loop is only partially filled with the liquid working fluid, and the part not filled with liquid is for the movement of the vapor plugs. In this or some other embodiments, the filling ratio of the working fluid in the loop approximately ranges between 30% and 70%. However, the filling ratio may be modified according to actual requirements, such as the application, the type of working fluid, etc., and the disclosure is not limited thereto.

Note that, in the chambers 1111, the working fluid is unable to distribute itself naturally in the form of liquid-vapor plugs. The reasons for this will be described in detail in later paragraphs.

Figure 3A:
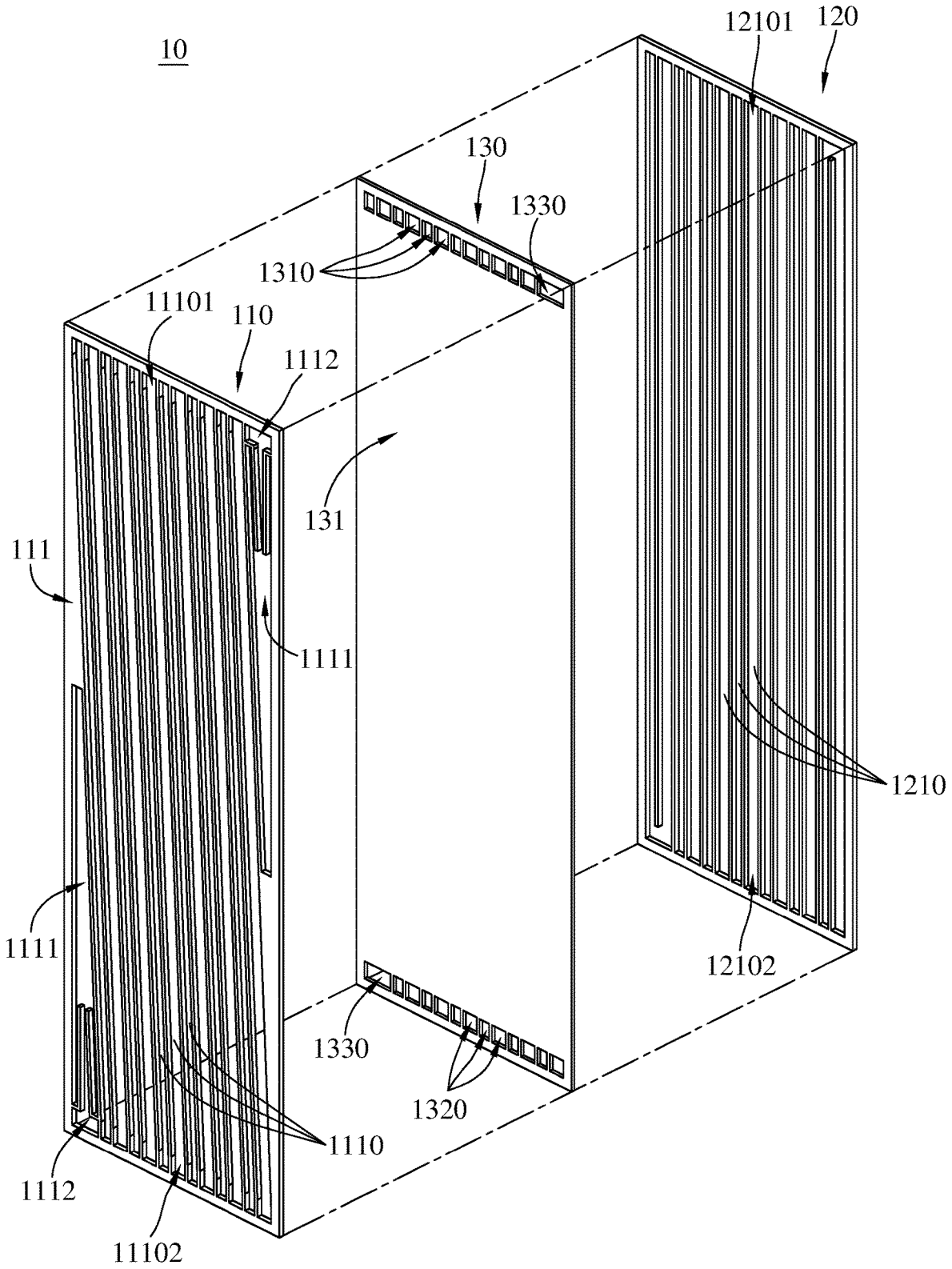
FIGS. 3A-3B are exploded perspective views of a channel plate of the pulsating heat pipe in FIGS. 2A-2B, taken from different viewpoints.
Figure 3B:
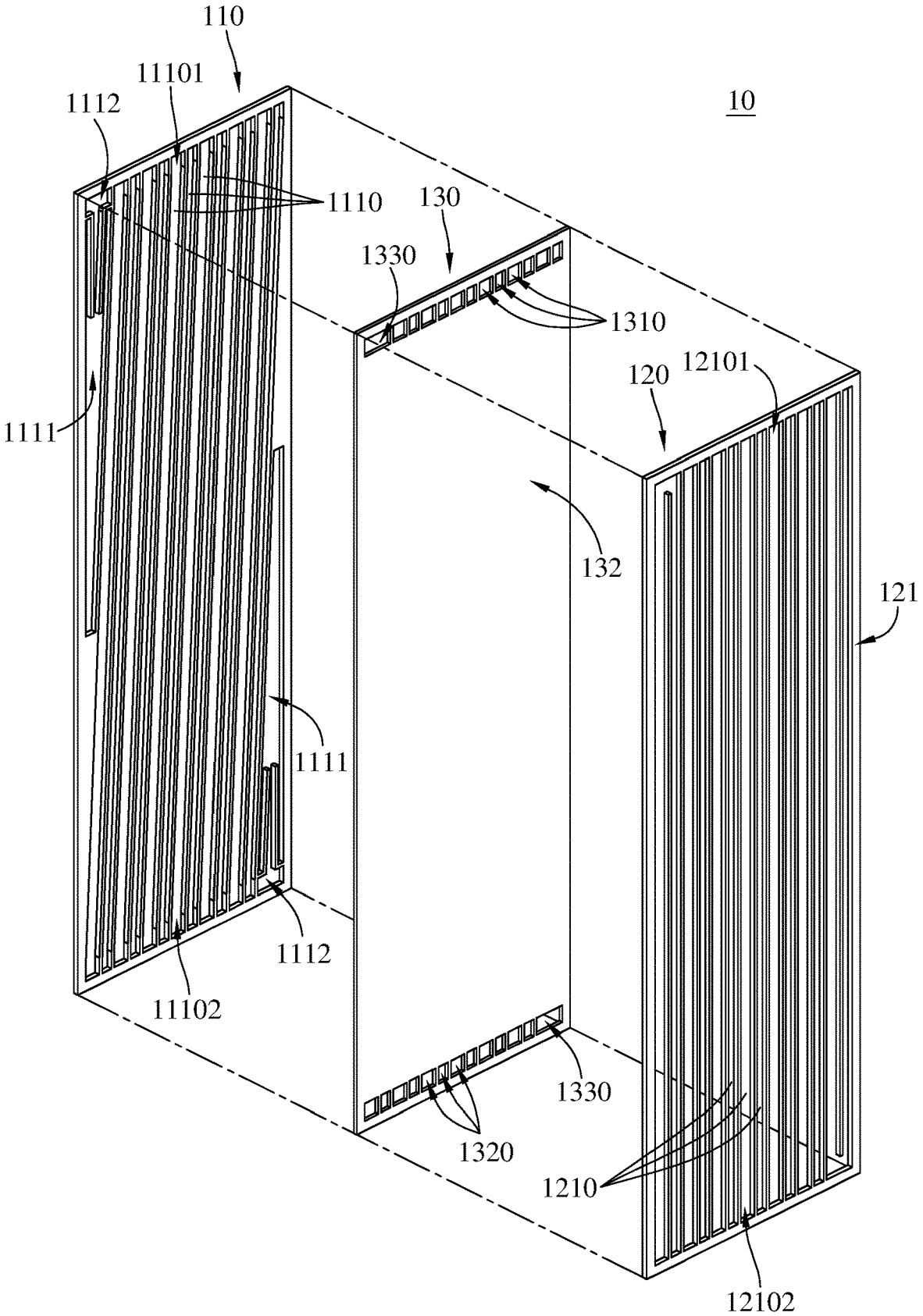

Please further refer to FIGS. 3A-3B, in this embodiment, the channel plate 10 is, but not limited to, formed of several plate pieces. As shown, the channel plate 10 includes a first plate part 110, a second plate part 120, and a middle plate part 130. The middle plate part 130 has a first engaging surface 131 and a second engaging surface 132 opposite to each other. The first plate part 110 and the second plate part 120 are respectively disposed on the first engaging surface 131 and the second engaging surface 132 of the middle plate part 130, such that the middle plate part 130 is located between and clamped by the first plate part 110 and the second plate part 120. Note that the first plate part 110 and the second plate part 120 are respectively fixed to the first engaging surface 131 and the second engaging surface 132 of the middle plate part 130 by, for example, welding, adhering, or any other suitable manner, but the disclosure is not limited thereto.

The aforementioned first surface 111, first channels 1110, and chambers 1111 are all formed on the first plate part 110 and penetrate through the first plate part 110. Each of the first channels 1110 has a first end 11101 and a second end 11102 opposite to each other. In addition, the first plate part 110 further has a port 1112 connected to the chamber 1111 and penetrating through the first plate part 110.

On the other hand, the aforementioned second surface 121 and the second channels 1210 are formed on the second plate part 120 and penetrate through the second plate part 120. Each of the second channels 1210 has a third end 12101 and a fourth end 12102 opposite to each other.

The middle plate part 130 is configured to fluidly connect the first channels 1110 and the chambers 1111 on the first plate part 110 to the second channels 1210 on the second plate part 120. Specifically, the middle plate part 130 at least has a plurality of first through holes 1310, a plurality of second through holes 1320, and a plurality of third through holes 1330, where the first ends 11101 of the first channels 1110 respectively connect to a part of the third ends 12101 of the second channels 1210 via the first through holes 1310, the second ends 11102 of the first channels 1110 respectively connect to a part of the fourth ends 12102 of the second channels 1210 via the second through holes 1320, and the ports 1112 of the first plate parts 110 respectively connect to two of the fourth ends 12102 and two of the third ends 12101 of the second channels 1210 via the third through holes 1330. It is understood that the thickness of the middle plate part 130 is not particularly restricted as long as it can fluidly connect the channels on the first plate part 110 and the second plate part 120.

As shown, one of the ports 1112, one of the third through holes 1330, and two of the third ends 12101 together form the aforementioned third passage 150; the other port 1112, the other third through hole 1330, and two of the fourth ends 12102 together form the aforementioned third passage 150'; the first ends 11101, the first through holes 1310, and the third ends 12101 together form the aforementioned first passages 141; and the second ends 11102, the second through holes 1320, and the fourth ends 12102 together form the aforementioned second passages 142.

Figure 4:
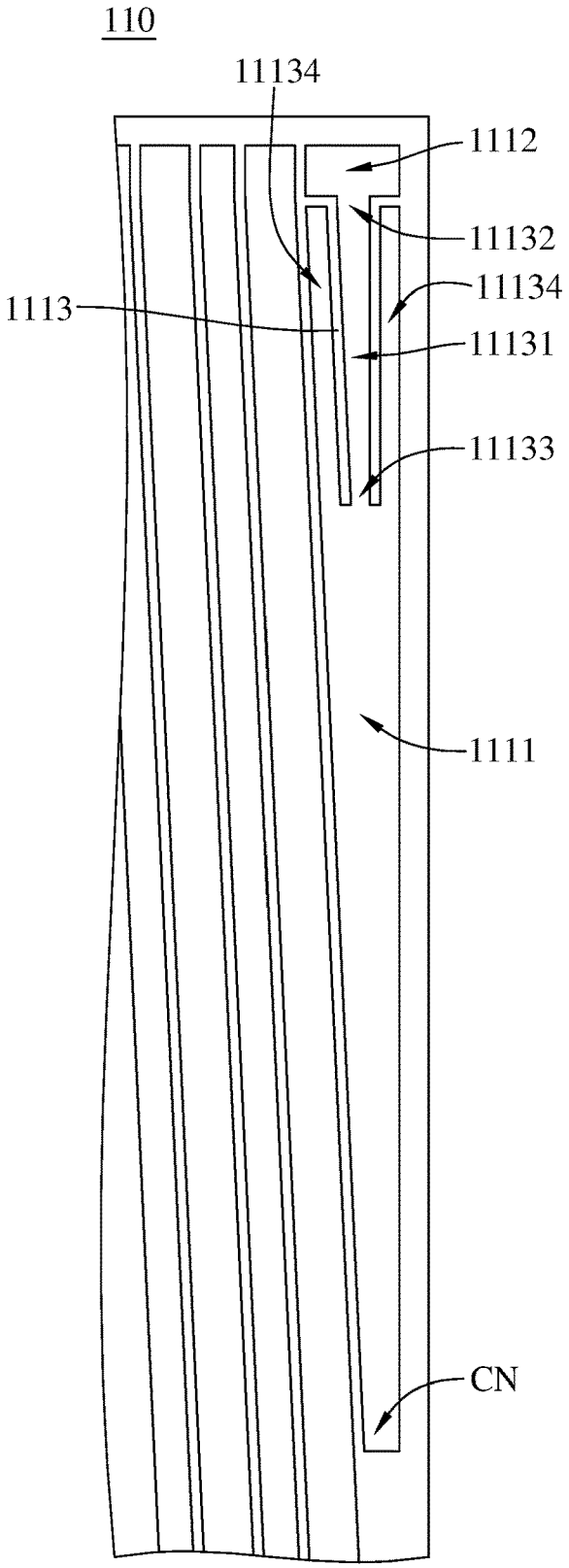
FIG. 4 is a partial enlarged planar view of the channel plate in FIG. 2A.

Then, pleaser further refer to FIG. 4 to introduce the detail of the chamber 1111. Note that the chambers 1111 on the channel plate 10 may have the same or similar configuration, thus FIG. 4 only depicts one of the chambers 1111 for the purpose of illustration. In this embodiment, the chamber 1111 does not have a fixed width; specifically, the shape of the chamber 1111 is, but not limited to, a trapezoid or a wedge. In addition, as shown, the chamber 1111 has a closed end CN, where the closed end CN is located opposite to the port 1112 and does not directly fluidly connect to other portions of the loop. That is, the closed end CN is located opposite to the third passage 150 and only directly fluidly connected to the chamber 1111.

In addition, in this embodiment, the first plate part 110 further has channel narrowing structures 1113 in the same quantity as the chambers 1111. As shown, the channel narrowing structure 1113 is arranged between the port 1112 and the closed end CN of the chamber 1111; that is, the port 1112 is connected to the chamber 1111 via the channel narrowing structure 1113. In more detail, the channel narrowing structure 1113 includes, for example, two L-shaped structures that form a narrow passage 11131 therebetween, and the channel narrowing structure 1113 and the inner surfaces of the chamber 1111 form at least one gap 11134 therebetween. The narrow passage 11131 has an outer end 11132 and an inner end 11133, where the outer end 11132 and the inner end 11133 respectively fluidly connect to the port 1112 and the chamber 1111. That is, the port 1112 is fluidly connected to the chamber 1111 only via the narrow passage 11131; in other words, the chamber 1111 is fluidly connected to the port 1112 only via the narrow passage 11131.

Figure 5A:
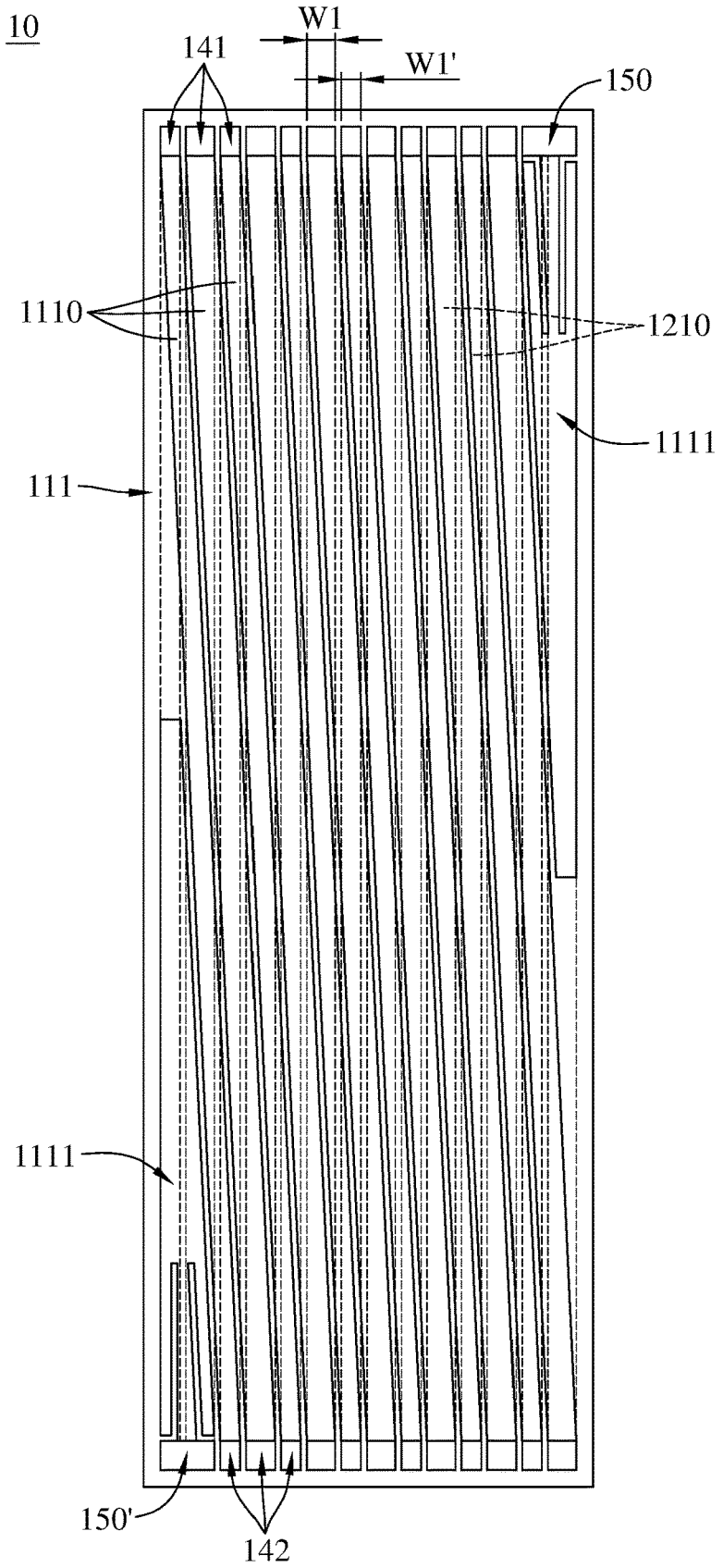
FIGS. 5A-5B are planar views of the channel plate of the pulsating heat pipe in FIGS. 2A-2B, taken from different viewpoints.
Figure 5B:
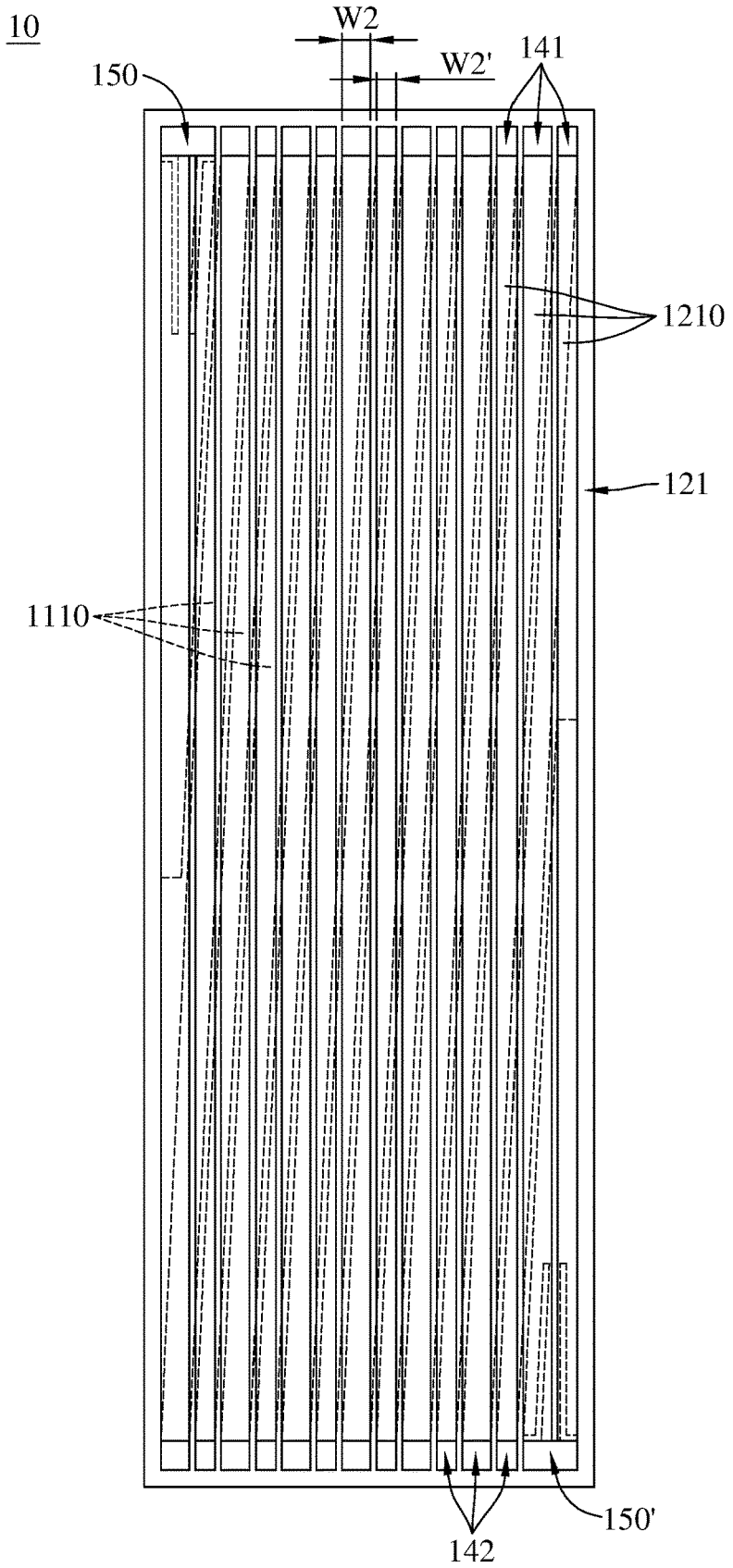

Then, please further refer to FIGS. 5A-5B, where FIGS. 5A-5B depict the planar views of different sides of the channel plate 10.

As discussed above, the first channels 1110 and second channels 1210, that are located on two opposite surfaces, and the first passages 141, second passages 142, and third passages 150 and 150', that are connected to the channels, are able to cause the working fluid to create a sufficient capillary force to make it distribute itself naturally in the form of liquid-vapor plugs that is oscillated in the loop. However, the hydraulic diameter $D_h$ of the chambers 1111 is at least larger than that of the other portions of the loop. In this or some other embodiments, the hydraulic diameter $D_h$ of the chamber 1111 at least satisfies the following condition:

$$2\sqrt{\frac{\sigma}{\Delta\rho g}} < D_h < 4\sqrt{\frac{\sigma}{\Delta\rho g}}$$

As mentioned above $$\left(Bo = \frac{\Delta\rho g D_h^2}{\sigma}\right), \text{ when } 2\sqrt{\frac{\sigma}{\Delta\rho g}} < D_h < 4\sqrt{\frac{\sigma}{\Delta\rho g}},$$

the Bo value of the chamber 1111 is at least larger than 4. Under this condition, the working fluid in the chamber 1111 is unable to create a sufficient capillary force or even unable to create capillary force to form a train of vapor bubbles and liquid plugs. In some embodiment, the hydraulic diameter of the chamber 1111 at least approximately 2.2 to 2.8 times the hydraulic diameter of the other portions in the loop.

In the cooperation with the channel narrowing structures 1113, as the liquid and vapor enter into the chamber 1111 through the third passage 150 or 150' and the outer end 11132 and inner end 11133 of the narrow passage 11131 of the channel narrowing structure 1113, the liquid working fluid can easily flow along the inner walls of the chamber 1111 to flow into the gaps 11134 on both sides of the channel narrowing structure 1113 due to its viscosity, but the vapors have smaller viscosity and are subjected to less resistance so it can easily escape the chamber 1111 through the narrow passage 11131. Therefore, it is less easy for the liquid working fluid to escape from the chamber 1111 so that the liquid can be kept in the chamber 1111 for a longer period of time to continuously absorb heat and generate more vapors. Consequently, the chamber 1111 becomes a substantially closed vapor chamber capable of increasing the driving force for the liquid movement so as to produce large oscillation amplitude, making the capillary force more unbalanced and uneven and thus promoting the circulation in the loop. Accordingly, the existence of the chamber 1111 can enhance the oscillating or pulsating motions so as to enable the operation under anti-gravity operation, thereby increasing the applicability and flexibility of the pulsating heat pipe 1.

Herein, please refer to Table 1 below, Table 1 shows the experimental comparison of the pulsating heat pipe 1 and an array of 12 conventional sintered heat pipes whose diameter is 6 mm and length is 250 mm. This experiment was performed from 100 W to 350 W, raising 10 W and lasting for approximately 600 seconds at a time. As shown, as the pulsating heat pipe 1 is operated in an upright and bottom heated position (+90 degree position) and at 350 W, the temperature of the heated end is approximately 80.2° C.; as the pulsating heat pipe 1 is operated in an upright and top heated position (−90 degree position) and initiated at approximately 200 W, the operation remains stable during the rise from 200 W to 350 W, and the temperature of the heated end is approximately 90.6° C. In contrast, to the array of conventional sintered heat pipes, the temperature of the heated end is approximately 87.3° C. while it operates in an upright and bottom heated position (+90 degree position) and at 350 W; but the temperature of the heated end goes up to approximately 90.3° C. and the operation still remains unstable while in the upright and top heated position (−90 degree position), and during the rise from 200 W to 250 W, the temperature even exceeds 100° C. and the operation is still unstable, meaning that the capillary force is insufficient to circulate the working fluid.

TABLE 1

| | pulsating heat pipe 1 | | sintered heat pipe array | |
|---|---|---|---|---|
| placement angle | +90 deg (bottom heated position) | −90 deg (top heated position) | +90 deg (bottom heated position) | −90 deg (top heated position) |
| power of resistive heater | >350 W | >350 W | >350 W | 200 W |
| temperature of heated end(° C.) | 80.2 | 90.6 | 87.3 | 90.3 |
| ambient temperature(° C.) | 30 | 30 | 30 | 30 |
| thermal resistance(° C./W) | <0.143 | <0.173 | <0.164 | >0.302 |

As can be seen in Table 1, in the requirements of high power, long channels, and anti-gravity operation, the pulsating heat pipe 1 has the chamber 1111 to perform a better oscillation effect so that it is available for 350 W or more, which is superior to the sintered heat pipe array; in addition, the thermal resistance of the pulsating heat pipe is smaller than that of the sintered heat pipe array. This shows that the pulsating heat pipe 1 can replace the sintered heat pipe.

In addition, as long as the channel narrowing structure 1113 allows the liquid and vapor to enter into the chamber 1111 while it is capable of making the liquid difficult to escape from the chamber 1111 and keeping the liquid in the chamber 1111 for a longer period of time, the design of the channel narrowing structure 1113 may be modified according to actual requirements. For example, in some embodiments, the channel narrowing structure 1113 may be a single L-shaped structure; in this case, there is only one gap 11134 in the chamber 1111, and the liquid still can slide along the chamber 1111 and flow into the gap 11134 formed by the L-shaped structure and the inner wall of chamber 1111.

Further, in this embodiment, the channel plate 10 includes three plate parts (i.e., the first plate part 110, the second plate part 120, and the middle plate part 130), and the features, such as the channels, passages, through holes, and/or ports all penetrate through the plate parts. Therefore, these plate parts may be manufactured by a less expensive and simple process, such as stamping. This helps to simplify the manufacturing process and reduce the cost, and also helps to improve the design flexibility and mass production. In contrast, some conventional flat heat pipes that are applicable for large-area heat transfer are composed of two substrates, the loop is etched on one of the substrates, and then the other substrate is welded to the substrate having the loop to seal the loop, but the etching process for the loop is time-consuming and costly.

However, the disclosure is not limited by the above channel plate. In some other embodiments, the channel plate may be made of a single piece, that is, the solid part of the channel plate is a single structure that was manufactured in the same process; in such a case, the appearance of the channel plate is the same or similar to the plate structure shown in FIG. 2A or 2B.

Additionally, the channel arrangement of the first channels 1110 and the second channels 1210 on the opposite surfaces of the channel plate 10 has a greater number of turns and channels to accommodate more working fluid. This helps to create a larger driving force for the liquid to move against the gravitational force and ensuring the oscillating motion whether the heat pipe is placed horizontal or in an upright position. In comparison with the conventional pulsating heat pipes whose channels are only formed on one side of the substrate, it is inferior to the pulsating heat pipe 1 under anti-gravity operation and horizontal operation.

Further, as shown in FIG. 5A or 5B, the first channels 1110 are not parallel to the second channels 1210, meaning that the first channels 1110 and the second channels 1210 are not symmetrically arranged on two opposite surfaces of the channel plate 10. As such, the loop has an uneven capillary pressure between the first surface 111 and the second surface 121 of the channel plate 10, which helps to increase the chaos of the working fluid in the loop to achieve high thermal performance. In contrast, to those having a symmetrical and simpler pulsating heat pipe arrangement, its fluid motion is easier to reach a stationary status and thus easily failing to achieve the desired thermal performance under anti-gravity operation. Note that the inclination of the first channels 1110 with respect to the second channels 1210 may be modified according to other design considerations or actual requirements, and the disclosure is not limited thereto.

In addition, in this or some other embodiments, the width of a part of the first channels 1110 is different from that of the other part of the first channels 1110, such that the hydraulic diameter of some of the first channels 1110 are different from that of the other first channels 1110. As the widths W1 and W1' shown in FIG. 5A, the first channels 1110 form an alternation of narrow channels and wide channels, which helps to increase the chaos of the flow resistance distribution in the loop to increase the randomness of the vapor bubbles and liquid plugs, making the working fluid more difficult to reach a stationary status. Note that, in some other embodiments, the first channels 1110 may also be composed of channels of more than three different widths to further increase the chaos of the flow resistance distribution in the loop; further, in some other embodiments, the first channels 1110 may have the same width so that the first channels 1110 may have uniform hydraulic diameters.

On the other hand, similarly, as the widths W2 and W2' shown in FIG. 5B, the second channels 1210 form an alternation of narrow channels and wide channels, such that the hydraulic diameter of a part of the second channels 1210 is different from that of the other second channels 1210. This arrangement of the second channels 1210 also helps to increases the chaos of the flow resistance distribution in the loop to increase the randomness of the vapor bubbles and liquid plugs, making the working fluid more difficult to reach a stationary status. Note that, in some other embodiments, the second channels 1210 may also be composed of channels of more than three different widths or have the same uniform width.

As discussed above, the arrangement of the first channels 1110 and second channels 1210, that are respectively located on two opposite surfaces of the channel plate 10, and the first passages 141, second passages 142, and third passages 150 and 150' connected to these channels not only can naturally produce asymmetric capillary pressure distribution but also can produce other two pressure differences due to flow resistance difference and mass inertia difference, ensuring that the oscillation of the working fluid in the loop is effective whether the pulsating heat pipe 1 is in a top-heated or bottom-heated position, thereby ensuring the thermal performance of the pulsating heat pipe 1.

Furthermore, in some other embodiments, the chambers 1111 on the channel plate 10 may be in different sizes or shapes as long as its hydraulic diameter satisfies the above condition to increase the chaos of the flow resistance distribution in the loop to increase the randomness of the vapor bubbles and liquid plugs.

In addition, in this embodiment, the chamber 1111 is simultaneously fluidly connected to two of the second channels 1210 via the third passage 150 or 150', but the disclosure is not limited thereto. For example, in some other embodiments, the chamber 1111 may be simultaneously fluidly connected to more than three second channels 1210 via the third passage 150 or 150'.

Figure 6:
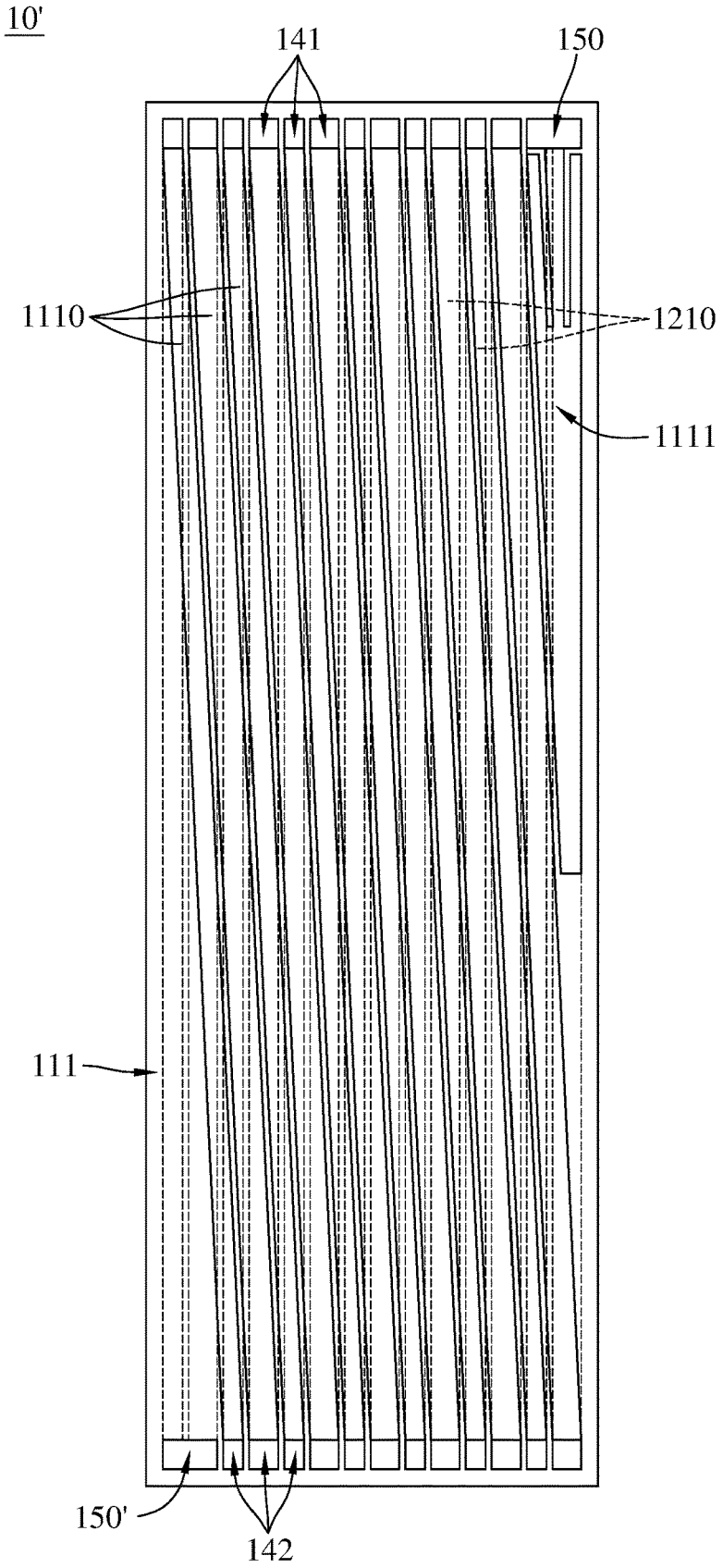
FIG. 6 is a planar view of a channel plate according to another embodiment of the disclosure.

Furthermore, in this embodiment, there are two chambers 1111 on the channel plate 10, but the disclosure is not limited thereto. For example, in some other embodiments, the channel plate may only have one chamber 1111. Referring to FIG. 6, a planar view of a channel plate 10' according to another embodiment of the disclosure is provided. As shown, the main difference between this embodiment and the previous embodiments is that the channel plate 10' includes only one chamber 1111 connected to the second channel 1210 via the third passage 150. In such an arrangement, the chamber 1111 is still able to increase the driving force for the liquid movement in the loop so as to ensure the oscillation of the working fluid as the pulsating heat pipe operates against the gravity.

In addition, in the embodiment of FIG. 6, another chamber 1111 may be formed on the surface of the first cover plate 11 that is attached to the first surface 111 of the channel plate 10'. In such an arrangement, the channel plate 10' has only one chamber 1111, and the other chamber 1111 is on the first cover plate 11 and is located between the first cover plate 11 and the first surface 111 of the channel plate 10'. However, the chamber 1111 on the first cover plate 11 is optional, and the disclosure is not limited thereto.

Lastly, it is noted that the size, quantity of the aforementioned channels, passages, through holes, and/or ports are not particularly restricted and may be modified according to the actual requirements.

According to the pulsating heat pipe as discussed in the above embodiments of the disclosure, since one end of the chamber on the channel plate is a closed end, the chamber is connected to the other channels only via the third passage, and the hydraulic diameter $D_h$ of the chamber at least satisfies the condition of $$D_h > 2\sqrt{\frac{\sigma}{\Delta\rho g}},$$

the chamber has a certain amount of portion in the loop so that the capillary action is less likely to occur in the chamber. Therefore, the liquid working fluid can be kept in the chamber for a longer period of time to continuously absorb heat and generate more vapor. This increases the internal pressure and driving force for the liquid movement so as to produce large oscillation amplitude, making the capillary force more unbalanced and uneven and thus promoting the circulation in the loop. As such, the existence of the chamber ensures the thermal performance of the pulsating heat pipe under anti-gravity operation and thus increasing the applicability and flexibility of the pulsating heat pipe.

In addition, the channel narrowing structure makes it less easy for the liquid working fluid to escape from the chamber, such that the chamber becomes a substantially closed vapor chamber that can increase the driving force to enhance the oscillating or pulsating motion.

Further, the channel arrangement of the first and second channels on the opposite surfaces of the channel plate has a greater number of turns and channels to accommodate more working fluid. This helps to create a larger driving force for the liquid to move against the gravitational force and ensuring the oscillating motion whether the heat pipe is placed horizontal or in an upright position.

In some embodiments, the channel plate may be composed of three plates that may be manufactured by a less expensive and simple process, such as stamping, which helps to simplify the manufacturing process and reduce the cost, and also helps to improve the design flexibility and mass production.

Furthermore, in some embodiments, the first channels and the second channels are not symmetrically arranged on two opposite surfaces of the channel plate. As such, the loop has an uneven capillary pressure between the first surface and the second surface of the channel plate, which helps to increase the chaos of the working fluid in the loop and thereby making the working fluid more difficult to reach a stationary status.

Moreover, in some embodiments, the first channels form an alternation of narrow channels and wide channels, such that the hydraulic diameter of some of the first channels is different from that of the other ones of the first channels; the second channels also form an alternation of narrow channels and wide channels, such that the hydraulic diameter of some of the second channels is different from that of the other ones of the second channels. This arrangement of channels can increase the chaos of the flow resistance distribution in the loop to increase the randomness of the vapor bubbles and liquid plugs, making the working fluid more difficult to reach a stationary status.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A pulsating heat pipe, comprising:

a channel plate, comprising a first surface, a second surface, a plurality of first channels, a plurality of second channels, a plurality of first passages, a plurality of second passages, at least one chamber, and at least one third passage, wherein the plurality of first channels and the at least one chamber are formed on the first surface, where the plurality of second channels are formed on the second surface, where the plurality of first passages, the plurality of second passages, and the at least one third passage penetrate through the first surface and the second surface;

wherein the at least one chamber does not penetrate through the second surface and the at least one chamber is not directly connected to the plurality of first channels, the plurality of first passages, and the plurality of second passages;

wherein the at least one chamber has a closed end, the closed end is located opposite to the at least one third passage and the closed end is connected to at least one of the plurality of second channels via the at least one third passage, the plurality of first channels and the plurality of second channels are connected via the plurality of first passages and the plurality of second passages, the at least one chamber has a hydraulic diameter of $D_h$ which satisfies the following condition:

$$D_h > 2\sqrt{\frac{\sigma}{\Delta\rho g}},$$

wherein σ is surface tension, Δρ is difference in density between liquid and vapor, and g is gravitational acceleration.

2. The pulsating heat pipe according to claim 1, wherein the at least one third passage is directly connected to the at least one chamber and at least two of the plurality of second channels.

3. The pulsating heat pipe according to claim 2, wherein on the second surface, at least two of the plurality of second channels are directly connected to the at least one third passage and the rest of the plurality of second channels are not directly connected to one another.

4. The pulsating heat pipe according to claim 1, wherein, on the first surface, the at least one chamber is not directly connected to the plurality of first channels and the plurality of first passages.

5. The pulsating heat pipe according to claim 1, wherein the channel plate further comprises at least one channel narrowing structure, the at least one channel narrowing structure is located on the first surface and located between the at least one third passage and the at least one chamber.

6. The pulsating heat pipe according to claim 5, wherein the at least one channel narrowing structure has a narrow passage, the at least one third passage is connected to the at least one chamber via the narrow passage, and the at least one channel narrowing structure and an inner wall of the at least one chamber together form at least one gap therebetween.

7. The pulsating heat pipe according to claim 1, wherein the at least one chamber does not have a fixed width.

8. The pulsating heat pipe according to claim 1, wherein the hydraulic diameter of Dh of the at least one chamber satisfies the following condition:

$$2\sqrt{\frac{\sigma}{\Delta\rho g}} < D_h < 4\sqrt{\frac{\sigma}{\Delta\rho g}},$$

wherein σ is surface tension, Δρ is difference in density between liquid and vapor, and g is gravitational acceleration.

9. The pulsating heat pipe according to claim 1, wherein any one of the plurality of first channels and the plurality of second channels has a hydraulic diameter of Dh which satisfies the following condition:

$$0.7\sqrt{\frac{\sigma}{\Delta\rho g}} \le D_h \le 1.8\sqrt{\frac{\sigma}{\Delta\rho g}},$$

wherein σ is surface tension, Δρ is difference in density between liquid and vapor, and g is gravitational acceleration.

10. The pulsating heat pipe according to claim 1, wherein the plurality of first channels are not parallel to the plurality of second channels.

11. The pulsating heat pipe according to claim 1, wherein a part of the plurality of first channels and another part of the plurality of first channels are different in width.

12. The pulsating heat pipe according to claim 1, wherein a part of the plurality of second channels and another part of the plurality of second channels are different in width.

13. The pulsating heat pipe according to claim 1, wherein each of the plurality of first channels has a first end and a second end opposite to each other, each of the plurality of second channels has a third end and a fourth end opposite to each other, the first ends of the plurality of first channels are respectively connected to the third ends of at least part of the plurality of second channels via the plurality of first passages, the second ends of the plurality of first channels are respectively connected to the fourth ends of at least part of the plurality of second channels via the plurality of second passages; wherein the at least one third passage is directly connected to at least two of the third ends, and the at least two of the third ends are directly connected to each other.

14. The pulsating heat pipe according to claim 1, wherein the channel plate comprises a first plate part, a middle plate part, and a second plate part, where the middle plate part is located between the first plate part and the second plate part, where the first surface, the at least one chamber, and the plurality of first channels are formed on the first plate part and the at least one chamber, where the plurality of first channels penetrate through the first plate part, where the second surface and the plurality of second channels are formed on the second plate part, where the plurality of second channels penetrate through the second plate part, where the plurality of first passages, the plurality of second passages, and the at least one third passage penetrate through the first plate part, the middle plate part, and the second plate part.

15. The pulsating heat pipe according to claim 1, wherein, on the first surface, the plurality of first channels are not directly connected to one another.

16. The pulsating heat pipe according to claim 1, further comprising a first cover plate and a second cover plate respectively disposed on the first surface and the second surface of the channel plate to seal a loop formed by the plurality of first channels, the plurality of second channels, the plurality of first passages, the plurality of second passages, the at least one chamber, and the at least one third passage.

17. The pulsating heat pipe according to claim 1, wherein the plurality of first channels, the plurality of second channels, the plurality of first passages, the plurality of second passages, the at least one chamber, and the at least one third passage are connected to form a loop configured to accommodate a working fluid, and a filling ratio of the working fluid in the loop approximately ranges between 30% and 70%.

* * * * *